US008745771B2

(12) United States Patent
Bates et al.

(10) Patent No.: US 8,745,771 B2
(45) Date of Patent: Jun. 10, 2014

(54) DRAIN CLOG REMOVER

(75) Inventors: Julie L. Bates, Franklin, WI (US); Steven A. Zach, Waterford, WI (US); John C. Taylor, Kenosha, WI (US); Ronald J. Schmidt, Grayslake, IL (US); Marc B. Frosch, Racine, WI (US); J. Gabriel Cleek, Vernon Hills, IL (US)

(73) Assignee: S.C. Johnson & Sons, Inc., Racine, WI (US)

( * ) Notice: Subject to any disclaimer, the term of this patent is extended or adjusted under 35 U.S.C. 154(b) by 562 days.

(21) Appl. No.: 12/629,084

(22) Filed: Dec. 2, 2009

(65) Prior Publication Data

US 2010/0132101 A1 Jun. 3, 2010

Related U.S. Application Data

(60) Provisional application No. 61/119,134, filed on Dec. 2, 2008.

(51) Int. Cl.
*E03D 9/00* (2006.01)

(52) U.S. Cl.
USPC ..... 4/255.04

(58) Field of Classification Search
CPC ..... A47K 17/00
USPC ..... 4/255.04, 255.01, 255.07
See application file for complete search history.

(56) References Cited

U.S. PATENT DOCUMENTS

| | | | | |
|---|---|---|---|---|
| 1,751,415 A | | 3/1930 | McCaffrey | |
| 1,803,425 A | | 5/1931 | Cunningham | |
| 1,825,851 A | | 10/1931 | Bropson | |
| 2,040,625 A | | 5/1936 | Myers | |
| 2,198,933 A | | 4/1940 | Damkroger et al. | |
| 2,283,780 A | * | 5/1942 | Ahern | 4/255.01 |
| 2,300,319 A | * | 10/1942 | Smith | 4/255.01 |
| 2,315,673 A | * | 4/1943 | Taylor | 4/255.07 |
| 2,608,421 A | * | 8/1952 | Schnepp | 285/222.5 |

(Continued)

FOREIGN PATENT DOCUMENTS

| | | | |
|---|---|---|---|
| DE | 19726583 | A1 | 12/1998 |
| EP | 0888977 | B1 | 1/1999 |
| GB | 2199814 | A | 7/1988 |
| WO | WO0248471 | A | 6/2002 |

OTHER PUBLICATIONS

PCT/US2008/005893 International Search Report and Written Opinion dated Aug. 22, 2008.

(Continued)

*Primary Examiner* — Lori Baker

(57) ABSTRACT

An apparatus for removing a clog from a drain pipe, the apparatus having: (a) a container comprising a product chamber; (b) a pressurization assembly in fluid communication with the inlet; (c) a shaft coupled to the container, the shaft comprising a proximal end and a distal end; and (d) projections extending outwardly from the shaft. The product chamber is adapted to receive a drain cleaning composition and the product chamber has an inlet and an outlet. The pressurization sub-assembly has a canister of pressurized fluid and an adapter coupled to the container and including a socket defining a receptacle configured to receive at least a portion of the canister. The shaft has an exterior surface sized for insertion into the drain pipe. The shaft also has a channel that provides fluid communication between the proximal end and the distal end.

5 Claims, 5 Drawing Sheets

(56) References Cited

U.S. PATENT DOCUMENTS

| | | | | |
|---|---|---|---|---|
| 2,723,056 | A | 11/1955 | Smith | |
| 2,770,399 | A | 11/1956 | Gross | |
| 2,789,734 | A | 4/1957 | Biederman | |
| 2,805,001 | A | 9/1957 | Biederman | |
| 3,050,217 | A | 8/1962 | Mackey | |
| 3,134,515 | A | 5/1964 | Callahan, Jr. | |
| 3,181,745 | A | 5/1965 | Grobowski | |
| 3,616,479 | A | 11/1971 | DeHart | |
| 3,972,446 | A | 8/1976 | Williams et al. | |
| 4,218,802 | A | 8/1980 | Babb et al. | |
| 4,271,556 | A | 6/1981 | Farrell, Jr. | |
| 4,312,679 | A * | 1/1982 | Klein, Sr. | 134/8 |
| 4,321,712 | A * | 3/1982 | Dixon | 4/255.04 |
| 4,426,003 | A | 1/1984 | Zarov | |
| 4,446,994 | A | 5/1984 | Smith | |
| 4,447,917 | A * | 5/1984 | Walter | 4/255.09 |
| 4,461,406 | A | 7/1984 | Vannucci | |
| 4,733,414 | A | 3/1988 | Wilkes | |
| 4,774,739 | A | 10/1988 | Sherman, Jr. | |
| 4,925,128 | A | 5/1990 | Brody | |
| 4,969,491 | A * | 11/1990 | Kiplinger | 141/1 |
| 5,004,025 | A | 4/1991 | Robbins | |
| 5,027,952 | A * | 7/1991 | Kiplinger | 206/524.5 |
| 5,056,176 | A | 10/1991 | Belcher | |
| 5,071,035 | A | 12/1991 | Kiplinger | |
| 5,139,179 | A | 8/1992 | Cecil | |
| 5,168,593 | A | 12/1992 | Poje et al. | |
| 5,221,029 | A | 6/1993 | Stull | |
| 5,242,422 | A | 9/1993 | Schneberger et al. | |
| 5,253,684 | A * | 10/1993 | Sternheimer et al. | 141/329 |
| 5,276,934 | A | 1/1994 | Brzoska | |
| 5,303,750 | A | 4/1994 | Sternheimer et al. | |
| 5,388,712 | A | 2/1995 | Brody | |
| 5,392,823 | A * | 2/1995 | Sternheimer et al. | 141/1 |
| 5,497,514 | A * | 3/1996 | Miller | 4/255.04 |
| 5,535,473 | A * | 7/1996 | Maniar | 15/104.33 |
| 5,609,189 | A | 3/1997 | Sternheimer et al. | |
| 5,681,154 | A | 10/1997 | Yang | |
| 5,725,129 | A | 3/1998 | Chapin et al. | |
| 5,769,960 | A | 6/1998 | Nirmel | |
| 5,799,645 | A | 9/1998 | Strader et al. | |
| 5,836,032 | A | 11/1998 | Hondo | |
| 5,846,011 | A | 12/1998 | Bernstein et al. | |
| 5,884,842 | A * | 3/1999 | Caine et al. | 239/251 |
| 5,908,256 | A | 6/1999 | Bernstein | |
| 5,996,597 | A | 12/1999 | Gallo | |
| 6,050,444 | A | 4/2000 | Sugg | |
| 6,112,925 | A | 9/2000 | Nahill et al. | |
| 6,131,775 | A | 10/2000 | Brody | |
| D435,944 | S | 1/2001 | Luoma | |
| 6,276,565 | B1 | 8/2001 | Parsons et al. | |
| 6,293,436 | B2 | 9/2001 | Faughnder et al. | |
| 6,295,659 | B1 * | 10/2001 | Sandness | 4/255.01 |
| 6,302,303 | B1 | 10/2001 | Reynolds | |
| 6,363,979 | B1 | 4/2002 | Chafin et al. | |
| 6,386,403 | B2 | 5/2002 | Parsons et al. | |
| 6,412,136 | B1 | 7/2002 | Rutkowski | |
| 6,426,701 | B1 * | 7/2002 | Levy et al. | 340/573.1 |
| 6,443,330 | B1 | 9/2002 | Kuboshima | |
| 6,479,444 | B1 | 11/2002 | Porticos et al. | |
| 6,491,187 | B2 | 12/2002 | Walters | |
| 6,508,410 | B1 | 1/2003 | Thomas, Jr. | |
| 6,583,103 | B1 | 6/2003 | Klinkhammer | |
| 6,594,849 | B1 | 7/2003 | Nimens | |
| 6,615,436 | B1 | 9/2003 | Burch, Jr. et al. | |
| 6,660,702 | B2 | 12/2003 | Ajmani et al. | |
| 6,758,411 | B2 | 7/2004 | Conway et al. | |
| 6,769,572 | B1 | 8/2004 | Cullotta | |
| 6,775,873 | B2 * | 8/2004 | Luoma | 15/104.33 |
| 6,863,080 | B2 | 3/2005 | Clatanoff et al. | |
| 6,916,104 | B2 | 7/2005 | Parsons et al. | |
| 6,922,854 | B2 | 8/2005 | Allenbaugh et al. | |
| D511,948 | S * | 11/2005 | Shaltiel | D8/14 |
| 6,959,524 | B2 | 11/2005 | Altonen et al. | |
| 6,971,555 | B1 | 12/2005 | Ghun | |
| 6,974,092 | B1 | 12/2005 | Leventhal | |
| D518,252 | S | 3/2006 | Wu | |
| 7,011,468 | B1 | 3/2006 | Leventhal | |
| 7,028,866 | B2 | 4/2006 | Kunesh et al. | |
| 7,063,095 | B2 * | 6/2006 | Barcay et al. | 134/166 R |
| 7,100,799 | B2 | 9/2006 | Gruenewald et al. | |
| 7,120,943 | B2 | 10/2006 | Allenbaugh et al. | |
| 7,163,130 | B2 | 1/2007 | Lafond | |
| 7,188,377 | B2 | 3/2007 | Smith et al. | |
| 7,188,753 | B2 | 3/2007 | Campbell | |
| 7,334,598 | B1 | 2/2008 | Hollars | |
| 7,340,783 | B2 | 3/2008 | Leaphart, Jr. et al. | |
| 7,350,265 | B2 | 4/2008 | Zhang | |
| 7,360,965 | B2 | 4/2008 | Coscarella | |
| 7,419,340 | B2 | 9/2008 | Zielinski | |
| 7,584,513 | B2 | 9/2009 | Turner | |
| 7,610,635 | B2 * | 11/2009 | Schultz et al. | 4/689 |
| D606,717 | S | 12/2009 | Xia | |
| 7,784,141 | B2 * | 8/2010 | Knopow et al. | 15/210.1 |
| 2002/0092877 | A1 | 7/2002 | Bowman | |
| 2003/0028956 | A1 | 2/2003 | Pangramuyen | |
| 2003/0215400 | A1 | 11/2003 | Schroeder et al. | |
| 2006/0021123 | A1 | 2/2006 | Turner | |
| 2006/0242776 | A1 | 11/2006 | Kurata | |
| 2007/0056586 | A1 | 3/2007 | Price et al. | |
| 2007/0089254 | A1 | 4/2007 | Alaine | |
| 2007/0151560 | A1 | 7/2007 | Price et al. | |
| 2007/0267447 | A1 | 11/2007 | Kennedy | |
| 2008/0083058 | A1 | 4/2008 | Heffner | |
| 2008/0086803 | A1 | 4/2008 | Stoltz | |
| 2008/0189844 | A1 | 8/2008 | Zucchero | |
| 2008/0276359 | A1 * | 11/2008 | Morgan et al. | 4/255.04 |
| 2008/0276392 | A1 | 11/2008 | Schultz et al. | |
| 2008/0313831 | A1 | 12/2008 | Kovach | |
| 2009/0293189 | A1 * | 12/2009 | Somerville | 4/597 |
| 2009/0293214 | A1 * | 12/2009 | Ackerman et al. | 15/104.05 |
| 2009/0320197 | A1 | 12/2009 | Turner | |
| 2010/0095443 | A1 * | 4/2010 | Nishimura et al. | 4/237 |
| 2010/0132101 | A1 * | 6/2010 | Bates et al. | 4/255.04 |
| 2010/0264046 | A1 * | 10/2010 | Bates et al. | 206/223 |

OTHER PUBLICATIONS

International Search Report and Written Opinion dated Mar. 30, 2010 Appl. PCT/US2009/006338.

* cited by examiner

FIG. 1
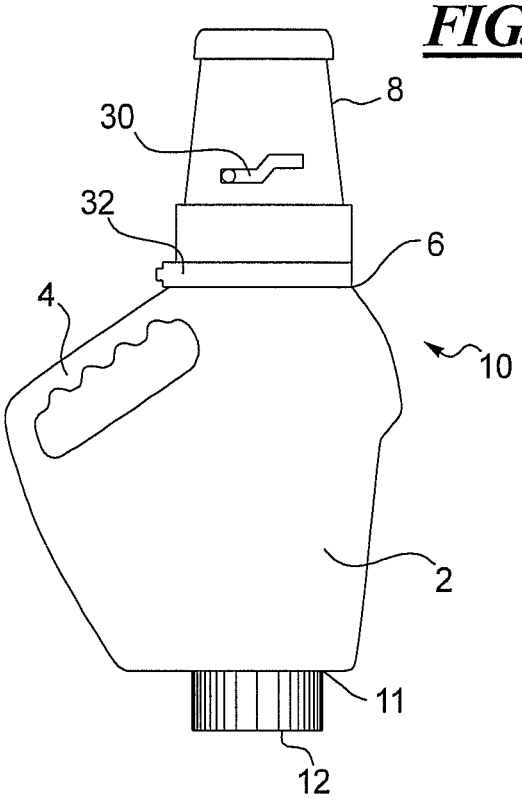
FIG. 2
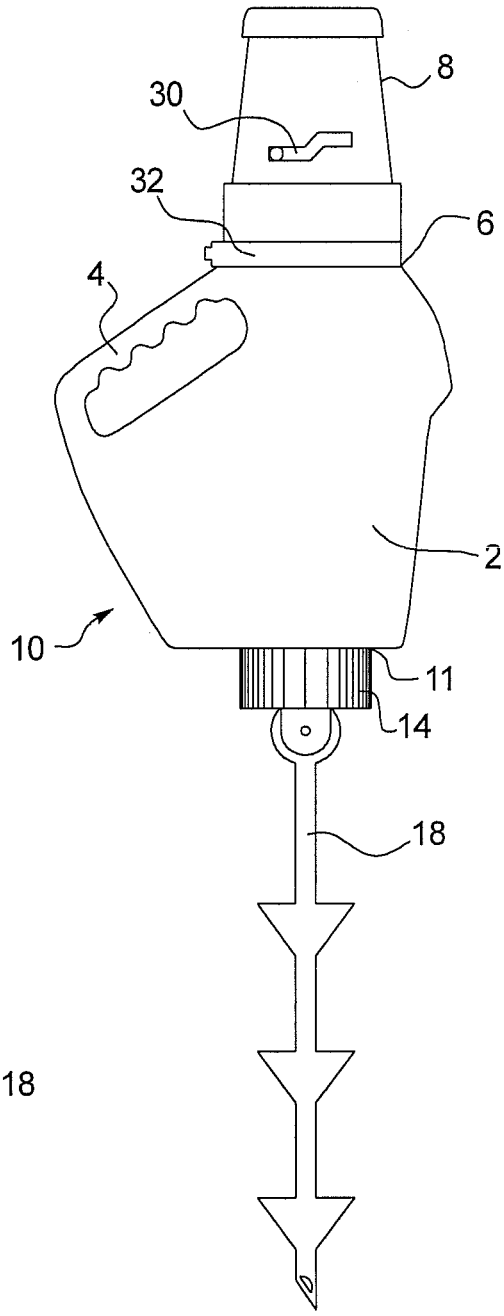
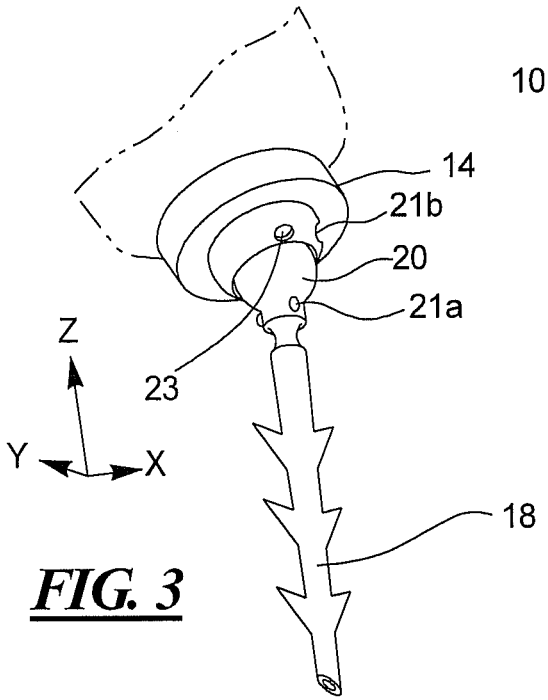
FIG. 3

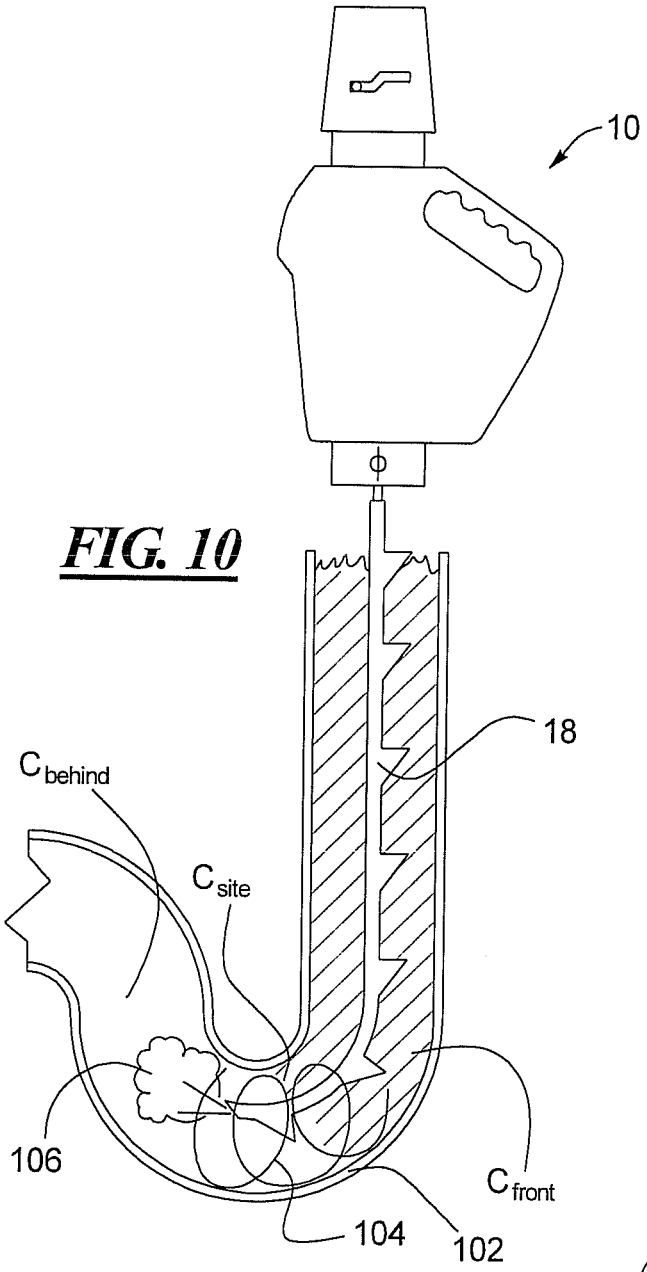
FIG. 10
FIG. 11
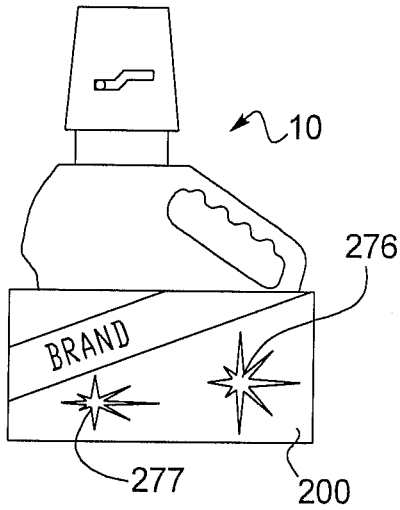

DRAIN CLOG REMOVER

CROSS-REFERENCE TO RELATED APPLICATIONS

This application claims the benefit of U.S. Provisional Application No. 61/119,134, filed Dec. 2, 2008.

REFERENCE REGARDING FEDERALLY SPONSORED RESEARCH OR DEVELOPMENT

Not applicable.

FIELD OF THE DISCLOSURE

The present disclosure generally relates to plumbing maintenance, and more particularly to apparatus and chemical compositions for removing clogs from drain pipes.

SUMMARY

In a first non-limiting embodiment, the present invention is directed to an apparatus for removing a clog from a drain pipe, the apparatus comprising: (a) a container comprising a product chamber, the product chamber being adapted to receive a drain cleaning composition, the product chamber having an inlet and an outlet; (b) a pressurization assembly in fluid communication with the inlet, the pressurization sub-assembly comprising a canister of pressurized fluid and an adapter coupled to the container and including a socket defining a receptacle configured to receive at least a portion of the canister; (c) a shaft coupled to the container, the shaft comprising a proximal end and a distal end, the shaft having an exterior surface sized for insertion into the drain pipe; the shaft further comprising a channel that provides fluid communication between the proximal end and the distal end; and (d) projections extending outwardly from the shaft.

In a second non-limiting embodiment, the present invention is directed to an apparatus for removing a clog in a drain pipe assembly, the apparatus comprising: (a) a first drain clog removal means; (b) a second drain clog removal means; wherein the first drain clog removal means is integral to the second drain clog removal means.

In a third non-limiting embodiment, the present invention is directed to a shaft for an apparatus for removing a clog in a drain pipe, the shaft comprising: (a) a main body having a length; (b) a distal end and a proximal end; (c) a channel for providing fluid communication between the distal end and the proximal end; (d) one or more protrusions extending outwardly from the body; and (e) one or more supporting flanges 28 extending outwardly from the body.

In a fourth non-limiting embodiment, the present invention is directed to an apparatus for removing a clog in a drain pipe wherein the apparatus is provided with at least one label, the label providing a first indicator, the first indicator communicating to the consumer that the device comprises at least two means for removing a clog.

BACKGROUND OF THE DISCLOSURE

Various types of mechanical apparatus and chemical compositions are known for removing clogs formed in drain pipes. In some of these, a mechanical apparatus is provided for engaging and removing the clog-forming material from the drain pipe. In one example, the device includes an elongate, flexible strip sized for insertion into the drain pipe. The strip has a length sufficient so that a distal end will contact the clog. The user may then apply pushing, pulling, twisting, or other force to the strip in an attempt to engage and/or dislodge all or part of the clog. The strip may include barbs or other projections extending from an exterior surface to improve the ability to snag or otherwise engage fibrous material that may be stuck in the drain pipe. Once the fibrous or other clog-forming material is engaged, the device is withdrawn from the drain pipe, bringing the clog-forming material with it.

Other types of devices attempt to dislodge the clog by providing a fluid jet that is directed toward the clog. These devices may be connected to a source of pressurized fluid such as water or air, and may include an elongate member having a channel extending therethrough to direct pressurized fluid toward the location of the clog.

Alternatively, various chemical compositions are known which are adapted to disintegrate or dissolve clogs formed in drain pipes. The chemical compositions are typically provided in containers, and the user simply pours the chemical composition from the container into an inlet of the drain. An exemplary arrangement is disclosed in U.S. Pat. No. 4,969,491 to Kiplinger, which includes a tube insertable into a drain for dispensing a chemical composition under the force of gravity.

While the above-noted mechanical and chemical approaches have met with some success, there is still a need for devices which more quickly and efficiently eliminate clogs from drain pipes.

BRIEF DESCRIPTION OF THE DRAWINGS

For a more complete understanding of the disclosed methods and apparatuses, reference should be made to the embodiment illustrated in greater detail on the accompanying drawings, wherein:

FIG. 1 is a side elevation view of a non-limiting embodiment of an assembled drain clog remover, constructed according to the present disclosure;

FIG. 2 is a side elevation view of an alternative non-limiting embodiment of an assembled drain clog remover, constructed according to the present disclosure;

FIG. 3 is a perspective view of a non-limiting embodiment of a shaft, constructed according to the present disclosure;

FIG. 10 is a cross-sectional view of a non-limiting embodiment of a drain clog remover as it may be used according to the present disclosure;

FIG. 11 is a side view of a non-limiting embodiment of a drain clog remover as it may be packaged according to the present disclosure;

Figure 4:
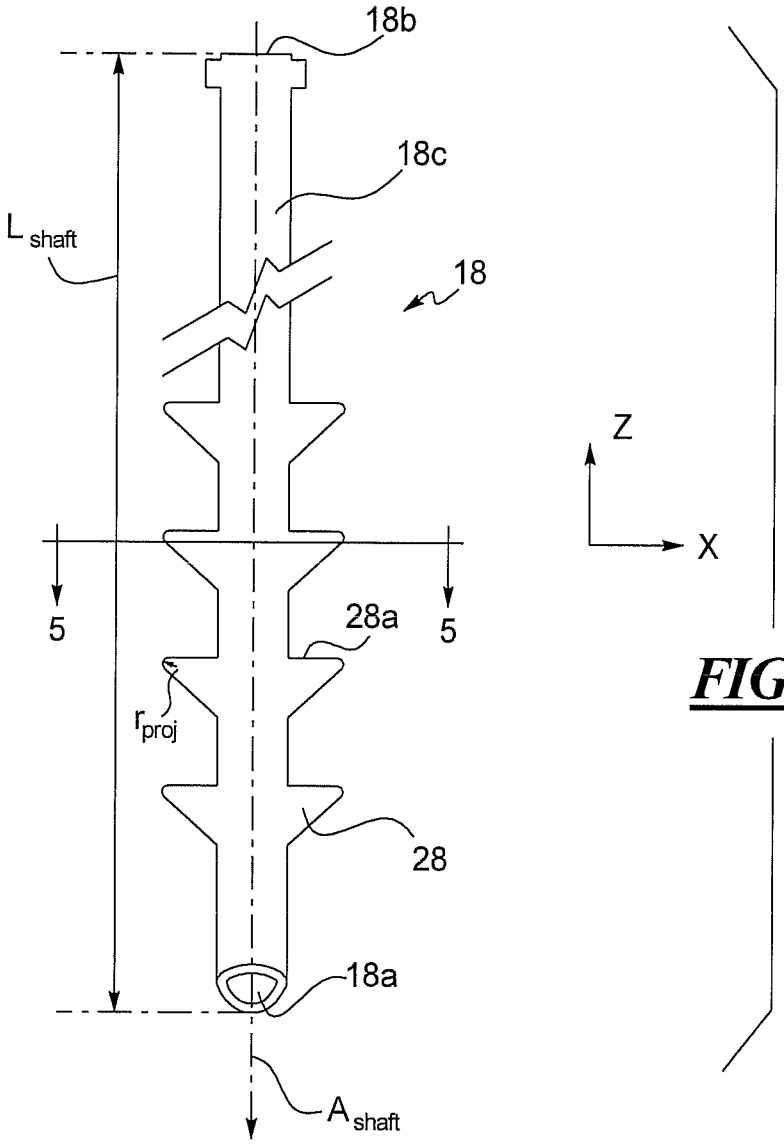
FIG. 4 is a top view of a non-limiting embodiment of a shaft, constructed according to the present disclosure.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

Drain clog removers are disclosed herein for removing clog-forming material from drain pipes. The drain clog removers may advantageously engage the clog both mechanically and chemically, thereby to efficiently remove the clog.

As used herein, the term "drain cleaning composition" encompasses any liquid, gel, or solid material, other than water or water from a plumbing supply (e.g. softened water; hard water), or combination thereof, which is used or marketed for use to remove drain clogs and/or to protect against drain clogs. Exemplary drain cleaning compositions include, but are not limited to, caustic materials such as sodium hydroxide, mixtures of sodium hydroxide, metal (e.g. aluminum) chips, and sodium nitrate, or alkaline sodium hypochlorite solutions (for example, as described in U.S. Pat. No. 4,080,305), as well as other cleaners such as laundry bleach or those with additives such as surfactants, proteolytic enzymes, and disulfide reducing agents. Exemplary cleaners are described in U.S. Pat. Nos. 4,540,506, 4,619,710 and 3,503,890.

As used herein, the term "chemical means" encompasses any drain clog composition or non-mechanical element(s) which may be used to remove a drain clog. A non-limiting example of a chemical means for drain clog removal is the Drano® Max product available from the S.C. Johnson & Son. Co. (Racine, Wis.).

As used herein, the term "mechanical means" encompasses any physical element(s) which may be used to remove a drain clog. In one embodiment, a physical means comprises a shaft having projections extending therefrom. Alternative non-limiting examples of mechanical means for drain clog are described in U.S. Pat. Nos. 6,775,873, 6,698,317, and 6,363,566.

As used herein, the term "clog forming material" refers to any material, which includes, but may not be limited to, fibrous material such as hair or other natural fibers. It is thought that such clog forming material may accumulate in a drain pipe assembly and consequently obstruct flow in the drain pipe assembly.

As used herein, the term "compatible with a drain pipe assembly" refers to any mechanical means for removing clog forming material wherein the mechanical means may be inserted into, and relatively easily removed from, the drain pipe assembly. In one embodiment, a mechanical means that is compatible with a drain pipe assembly comprises an X-direction, Y-direction perpendicular to the X-direction, and a Z-direction perpendicular to both the X- and Y-directions.

A non-limiting exemplary drain clog remover 10 is illustrated in FIGS. 1 and 2. As shown in FIG. 1, the drain clog remover 10 includes a container 2 for holding and/or accepting a drain cleaning composition (not shown). In some embodiments, the container 2 includes a handle 4 and the container has an upper end 6 coupled to a pressurization assembly 8 and a lower end 11 with a cap 12, or some other closure mechanism. One of skill in the art will appreciate that the pressurization assembly 8 may be located at any portion of the container 2. The handle 4 may provide for a relatively easy area for the user to grip and/or use as a means to agitate the drain clog remover 10.

In some embodiments, the sub-assembly 14 may further include a shaft 18 coupled to the base which allows a user to manually remove drain-clogging material while providing a conduit for more precisely directing the drain cleaning composition to the desired location within the drain pipe. A channel 17 (FIG. 5) or other delivery passage extends through the interior of the shaft 18. In one embodiment, the channel 17 or other delivery passage extends from the proximal end 18*b* to the distal end 18*a* of the shaft (FIG. 4). The shaft comprises a body portion 18*c* having some length (FIG. 4). In some non-limiting embodiments, the fluid communication that is facilitated may be a pathway for some drain cleaning composition (such as Drano®, manufactured and sold by S.C. Johnson & Son, Inc., Racine, Wis.) to travel from the container and onto the drain clog material itself, and the like. In some embodiments, the shaft 18 may include one or more projections 28 (FIG. 4) extending outwardly from the surface of the shaft 18. The projections 28 may be adapted to grip clog forming material located within the drain pipe. As used herein, the phrase "adapted to grip" includes structures that engage, snag, or otherwise engage and/or hold materials that typically form clogs in drain pipes. In the illustrated, non-limiting example, the projections 28 are formed as barbs which may be configured for gripping fibrous materials such as hair that may be lodged in the drain pipe.

The shaft 18 may be formed of a flexible material which allows it to be bent into an arcuate shape so that it can traverse a tortuous path, such as those commonly presented by typical P-trap and U-trap drain pipes 102 (FIG. 10). Accordingly, the shaft 18 may be formed of any flexible or semi-flexible metal, plastic, or other material, such as polypropylene, polyethylene, polyethylene terephthalate, high density polyethylene, low density polyethylene, or similar material.

As is shown in the non-limiting embodiment of FIG. 2, the cap 12 (FIG. 1) may be removed and a shaft 18 and/or other sub-assembly 14 may be coupled to the container at the lower end 11. The sub-assembly 14 may include a base 16 that may be threadably engaged to the container lower end 11 where the cap 12 is removably located. Such a configuration would allow a producer to provide a consumer with relative compact packaging. However, one of skill in the art will appreciate that the drain clog remover 10 may be provided as shown in FIG. 2 at the point of sale to provide a ready-to-use product for consumers. In some embodiments, the base may be sized to provide a splash guard for preventing water, particles, or other fluid and/or materials in the drain 102 (FIG. 10) from traveling toward the user during use.

In some embodiments, the sub-assembly 14 and/or base and/or shaft 18 may also be provided such that a shaft 18 is connected to the drain clog remover 10 such that there is fluid communication provided between the pressurization assembly 8 and the shaft 18. In some embodiments, the shaft 18 may provide fluid communication between the pressurization assembly 8 and the drain 102 (FIG. 9) through the container 2 and shaft 18.

FIG. 3 shows a non-limiting embodiment of a sub-assembly 14. In the embodiment shown, the sub-assembly 14 includes a valve 20, such as a ball valve, which provides for fluid communication between the container (not shown) and the shaft 18. The valve 20 may be rotatably mounted on the sub-assembly 14 to provide for the drain clog remover to be able to be packed and/or stored in a relatively compact configuration. In some embodiments, the fluid communication may be toggled to an opened and/or closed configuration by rotating the valve 20. In the embodiment shown a hinge 23 is provided to connect the valve 20 to the sub-assembly 14. The hinge 23 also provides an axis for rotation for the valve 20. In the embodiment shown, when the shaft 18 (and subsequently the valve 20) is in the X-Y plane, the valve 20 is in a closed configuration—thus not providing fluid communication between the pressurization assembly 8 (FIG. 2) and the shaft 18. Conversely, when the shaft 18 (and subsequently the valve 20) is parallel with the Z-axis, then the valve is in an open configuration—thus providing fluid communication between the pressurization assembly 8 (FIG. 2) and the shaft 18. In the embodiment shown in FIG. 3, the valve 20 has one or more fittings 21*a* which may be mechanically engaged with the receiving slots 21*b* on the sub-assembly 14. The receiving slots 21*b* may help hold the valve 20 in a closed configuration. Further, in some configurations an O-ring may be provided between the container 2 and the sub-assembly 14 to provide extra sealing and preventing any leakage of drain cleaning composition from the container 2.

FIG. 4 shows a top view of a shaft 18 according to one embodiment of the present invention. The shaft comprises a proximal end 18*b* and a distal end 18*a*. The proximal end 18*b* may be sized to form a seal around an outlet portion of the sub assembly 14 (FIG. 3), such as a valve 20 (FIG. 3), and the distal end 18*a* may be provided with an opening in order to facilitate fluid communication between the pressurization assembly 8 (FIG. 2), container 2 (FIG. 2), and a drain 102 (FIG. 10). The shaft 18 may comprise one or more projections 28 that extend outwardly from the surface of the shaft 18, in one embodiment, extending from the body 18*c*.

Figure 5:
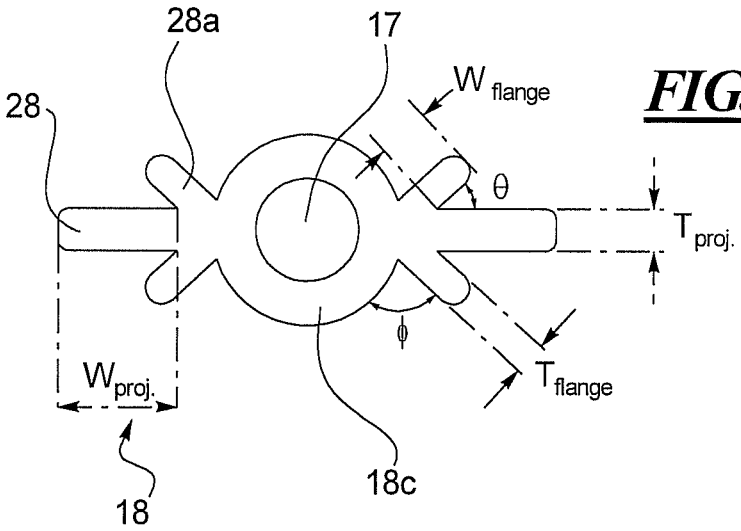
FIG. 5 is a cross-sectional view of the shaft of FIG. 4 taken along line 5-5.

FIG. 5 shows a cross-sectional view of the shaft 18 of FIG. 4 taken along line 5-5 of FIG. 4. In the embodiment shown, the shaft 18 comprises one or more projections 28 in addition to one or more supporting flanges 28*a* that extend outwardly from the surface of the shaft. The projections 28 may comprise a width ($w_{proj.}$) of from about 0.1" to about 0.4". In another embodiment, the projections 28 may comprise a width ($w_{proj.}$) of from about 0.15" to about 0.25". The projections 28 may comprise a thickness ($T_{proj.}$) of from about 0.02" to about 0.1". In another embodiment, the projections 28 may comprise a width ($T_{proj.}$) of from about 0.04" to about 0.08". The shaft 18 may also comprise a channel 17 or other passageway that may be used to facilitate fluid communication between the distal end 18*a* and the proximal end 18*b* of the shaft. Further, the channel 17 may also facilitate fluid communication between the pressurization assembly 8 (FIG. 2) and/or container 2 and the distal end 18*a* of the shaft 18. Flanges 28*a* may have a width ($w_{flange}$) of from about 0.3" to about 0.7". Flanges 28*a* may have a thickness ($T_{flange}$) of from about 0.01" to about 0.05". In another embodiment, the flanges 28*a* may have a thickness of from about 0.02" to about 0.03". In some embodiments, a projection-to-flange angle (θ) of from about 15° to about 70° may be provided. In some embodiments still, a projection-to-flange angle (θ) of from about 30° to about 50° may be provided. In some embodiments, a shaft-to-flange angle (ϕ) of from about 20° to about 75° may be provided. In some embodiments still, a shaft-to-flange angle (ϕ) of from about 30° to about 60° may be provided. In one embodiment, there are from about 2 to about 8 flanges 28*a* extending from the body 18*c* of the shaft 18. In another embodiment, there are from about 4 to about 6 flanges 28*a* extending from the body 18*c* of the shaft 18. In one embodiment, the flanges 28*a* are substantially continuous along the length of the shaft 18. In another embodiment, the flanges 18*a* are at least about ⅓ of the length of the shaft 18.

In the exemplary embodiment, the shaft may provide a mechanical means. In some embodiments, the shaft 18 allows a user to manually remove drain-clogging material while providing a conduit to provide a relatively precise directional guidance of the composition to the desired location within a drain pipe. In some embodiments the shaft 18 may include multiple outlets formed along its length for additional discharge of composition. In other non-limiting embodiments, the shaft 18 may be from about 3" to 20" in length. In still other non-limiting embodiments, the shaft 18 may be from about 6" to about 15" in length. In yet other embodiments, the shaft 18 may be from about 6" to about 12" in length.

As discussed herein, the projections 28 may extend from an exterior surface of the shaft 18. In the exemplary embodiment, the projections 28 are formed as barbs that extend outwardly from the shaft 18. The projections 28 may form an acute angle with respect to the base of the projection 28*a* (FIG. 4) and the axis of the shaft ($A_{shaft}$) (FIG. 4). In other embodiments, the projections may form a relatively right, and/or even an obtuse angle with the axis of the shaft 18 depending on the specific needs that one of skill in the art would require for the particular shaft. Surprisingly, it is discovered that the extensions 18 need not be particularly jagged or sharp. In one embodiment, the projections 28 are relatively rounded and may have a radius of curvature ($r_{proj.}$) (FIG. 4) of from about 0.01" to about 0.10". In another embodiment, the projections 28 may have a radius of curvature of from about 0.04" to about 0.07".

Surprisingly, it is found that the flanges 28*a* not only provide a stiffening effect on the wand itself in the direction lateral to the axis of the wand (i.e., stiffening effect in the X-direction), the flanges 28*a* may also provide an improvement in manufacturability of the shaft 18 itself. In some embodiments, the shaft 18 is molded by heating suitable material (described herein) and casting the material in a mold. By providing at least one flange 28*a*, the molded material cools at a more rapid pace and more evenly than a shaft 18 that does not have at least one flange 28*a*. A flange 28*a* may be distinguished from a projection 28 in that a flange 28*a* is substantially continuous along the length of the shaft 18 wherein a projection 28 is discontinuous from other elements along the length of the shaft 18. Surprisingly, it may be observed that a shaft 18 having flanges 28*a* formed by molding provides a much more regular configuration than a shaft 18 having the same geometry otherwise (i.e., same sized projections, channel, length, material, and the like).

The pressurization assembly 8 may produce a discharge force for pushing drain cleaning composition through the shaft 18. The pressurization assembly 8 may take any form sufficient to produce a discharge force, such as an aerosol container holding propellant, a mechanical actuator (such as a spring and piston arrangement), a syringe style actuator, a collapsible bellows style actuator, or any other suitable type of pressurizing actuator. In one embodiment, the pressurization assembly 8 is an aerosol container holding compressed air. In a specific embodiment, the compressed air may have a pressure of from about 60 psi to about 90 psi.

The pressurization assembly 8 may include a trigger, or other means for activating the pressurization assembly 8. In the illustrated embodiment, the trigger is a twist action of the pressurization assembly 8 wherein the assembly 8 may be twisted along a guide track 30 (FIGS. 1 and 2) to allow a user to start the release of fluid and/or gas from the pressurization assembly 8 which activates the pressurization assembly 8 to release a discharge force that drives the drain cleaning composition out of the container 2 and through the shaft 18. It is thought that by using a guide track 30, it is possible to prevent unwanted discharge of the pressurization assembly 8 because of the side-to-side motion required to activate. In another embodiment, in order to prevent accidental actuation of the pressurization assembly 8, a moveable or frangible safety tab 32 may be provided at, or near, the guide track 30 and/or trigger. In the embodiments shown in FIGS. 1 and 2, the safety tab 32 is a removable clip that physically blocks the downward movement, and in the embodiment shown, activation, of the pressurization assembly 8. More detail is devoted below.

Figure 6:
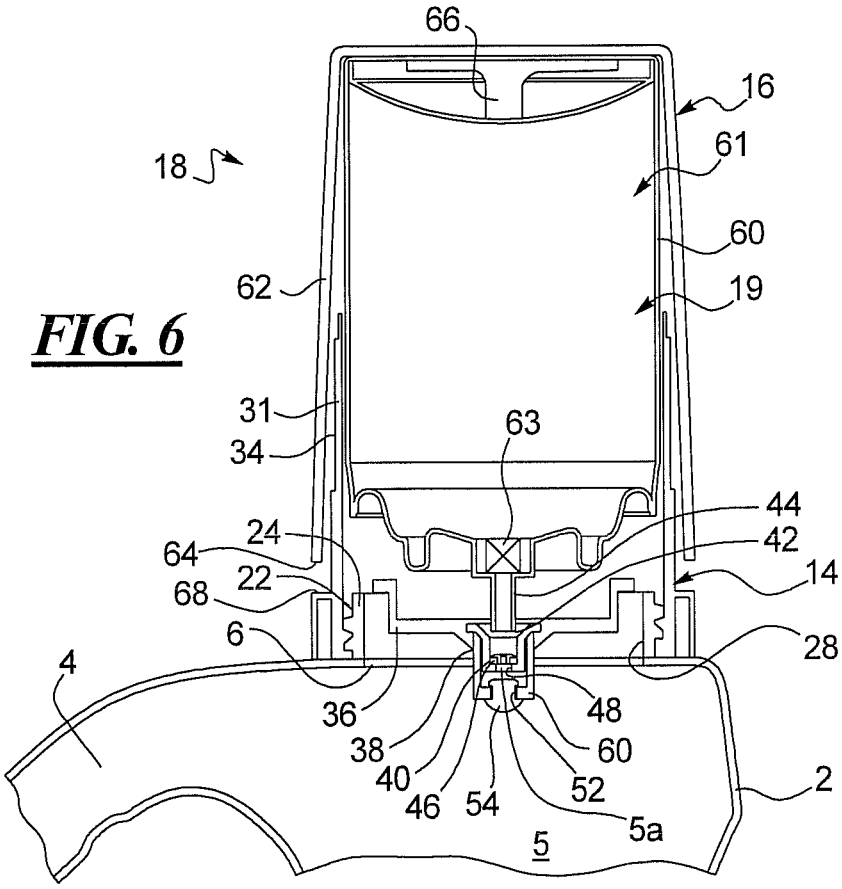
FIG. 6 is a cross-sectional view of a non-limiting embodiment of a pressurization assembly, constructed according to the present disclosure.

FIG. 6 shows a cross-sectional view of various aspects of the pressurization assembly 8. The pressurization assembly 8 includes a socket 36 for actuating the canister 19. In the non-limiting embodiment shown, the socket 36 includes a central receptacle 38. An actuation insert 40 is disposed in the central receptacle 38 and is configured to engage a distal end 42 of a stem 44 extending out of the canister 19. An O-ring 46 may be disposed inside the insert 40 to seal between the stem 44 and insert 40. An orifice 48 is formed in the insert 40 and fluidly communicates between the insert 40 and a lower portion 50 of the central receptacle 38. The central receptacle lower portion 50 defines a port 52 fluidly communicating between the lower portion 50 and the product chamber 5. The container 2 comprises an inlet 5*a* and an outlet 5*b* (FIG. 8) that may provide fluid communication between the pressurization assembly 8, the product chamber 5, and the sub-assembly 14. A valve, such as an umbrella valve 54, is disposed in the port 52 for controlling fluid flow therethrough. For example, the umbrella valve 54 may act as a check valve by allowing fluid to flow from the canister 19 into the product chamber 5 while preventing fluid flow in the reverse direction.

The pressurization canister 19 includes a side wall 60 defining a chamber 61 adapted to hold a pressurized fluid, such as compressed air. The pressurized fluid may be provided in any form and material suitable for propelling the chemical composition through the chamber outlet 5*b* of the container 2. For example, the pressurized fluid may be a pressurized gas, such as air, carbon dioxide, or nitrogen. A stem valve 63 is provided for controlling discharge of pressurized fluid from the container 60. The stem valve 63 includes the stem 44 which defines the distal end 42, both of which are noted above. The stem valve 63 may be configured to have a normally closed position, but may be actuated to an open position by linear or lateral displacement of the stem 44.

The actuation cap 16 has a side wall 62 sized to receive the canister 19. A lower end 64 of the side wall 62 is further sized to receive the outer surface 34 of the adapter outer wall 31. The cap 16 further includes a boss 66 configured to engage a bottom of the canister 19. The cap 16 has an initial position, in which the side wall lower end 64 is spaced from a stop surface 68 of the adapter 14. A removable or frangible spacer (32, FIGS. 1 and 2) may be positioned between the cap lower end 64 and the stop surface 68 to maintain the cap 16 in the initial position. The cap 16 is slidable along the adapter outer wall 31 and/or the guide track 30 (FIGS. 1 and 2) to an actuated position, in which the side wall lower end 64 engages or is adjacent to the stop surface 68. Movement of the cap 16 also causes the canister 19 to move so that the stem distal end 42 engages the actuation insert 40, thereby releasing pressurized fluid into the product chamber 5.

Figure 7:
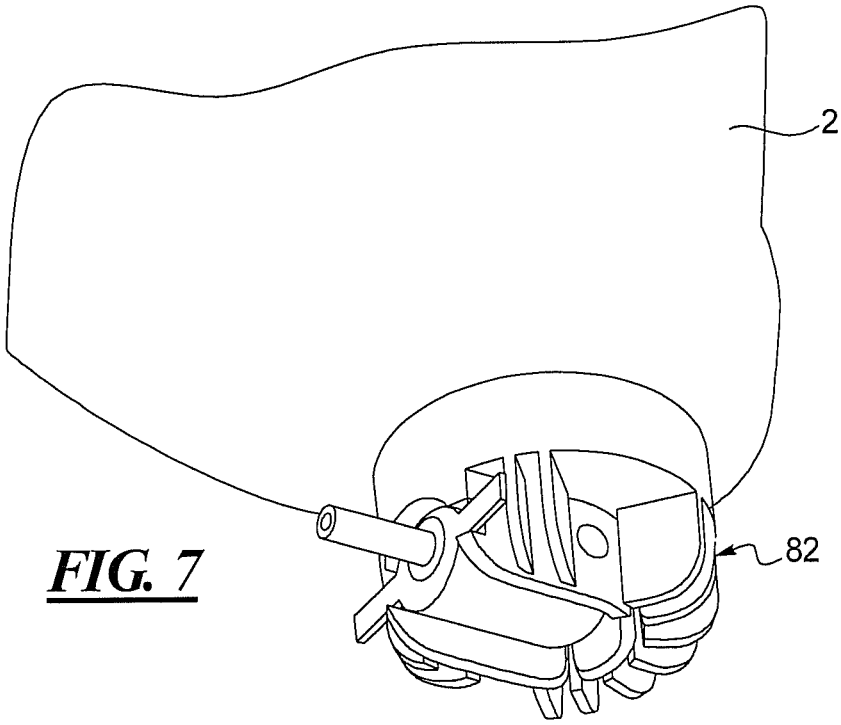
FIG. 7 is a perspective view of a non-limiting embodiment of a discharge valve body, constructed according to the present disclosure.
Figure 8:
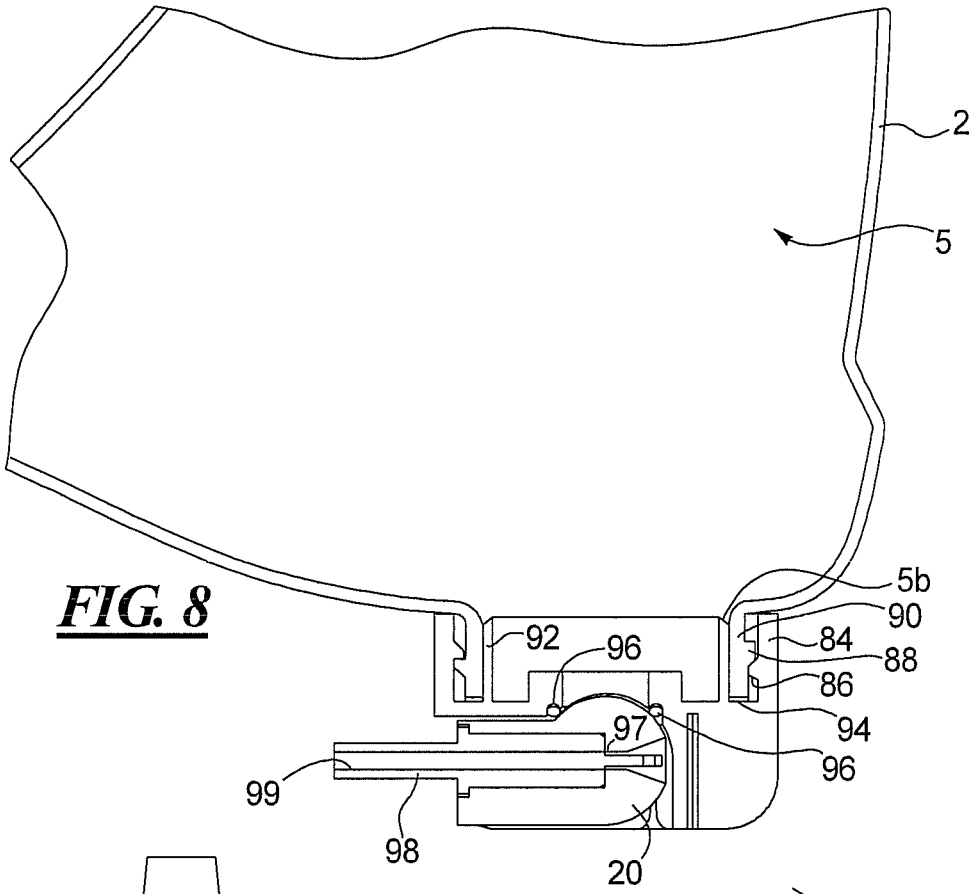
FIG. 8 is a cross-sectional view of the discharge valve body of FIG. 7 taken along line 8-8.

In some embodiments, a discharge valve body 82 is coupled to the product chamber outlet 58, as best shown in FIGS. 7 and 8. The discharge valve body 82 includes a side wall 84 having internal threads 86 configured to engage external threads 88 formed on an outlet neck 90 of the container 2. The discharge valve body 82 includes an inner sheath 92 configured to sealingly engage an inner surface of the outlet neck 90, thereby to form a plug seal therebetween. A face seal 94 is disposed between the outlet neck 90 and discharge valve body 82 thereby to ensure a liquid tight seal therebetween. A ball valve 20 is disposed in a valve seat 96 and is movable between closed and open positions. The ball valve 20 includes a passage 97 through which product may flow. A connector 98 is coupled to the ball valve 20 and includes an internal passage 99 in fluid communication with the ball valve passage 97. An O-ring 91 is disposed between the ball valve 20 and the valve body 82 to prevent fluid leakage around the ball valve 20.

Combined Mechanical and Chemical Unit

As described above, many drain clog removers provide a single mode of operation (i.e., chemical only). For example, the Liquid Plumbr® product (The Clorox Co., Oakland, Calif.) provides customers with a product that may be poured down the drain from the sink. Consumers may not have complete confidence with such a product, though, due to the fact that once the product is dispensed into the sink, then the consumer is left to wait for the product to perform its intended task. Such "pour and pray" drain clog removal systems, while effective on certain clog types, do not allow consumers to engage with the clog itself.

Conversely, a purely mechanical means may not provide enough assistance to the user for clogs which may result from a long-period of poor maintenance. For example, the accumulation of grease over the course of years may form a fairly hard deposit (clog) within a drain. The use of a mechanical means, such as a "drain snake", may not effectively address such a clog due to limitations such as from the strength of a user.

Until the present invention, there exists the need for an all-in-one solution that removes the confusion of which product is right for the consumer. Such a problem is especially prevalent because a consumer has no way to know which kind of clog they may be contending with. Further, it is impractical and/or impossible for a consumer to apply multiple means of drain clog removal simultaneously due to safety and/or functionality concerns. In particular, it is often discouraged to provide any agitation to the area of the sink while a chemical means is in the drain because of any unintended splashing that may occur while chemical means is present in the sink.

Figure 9:
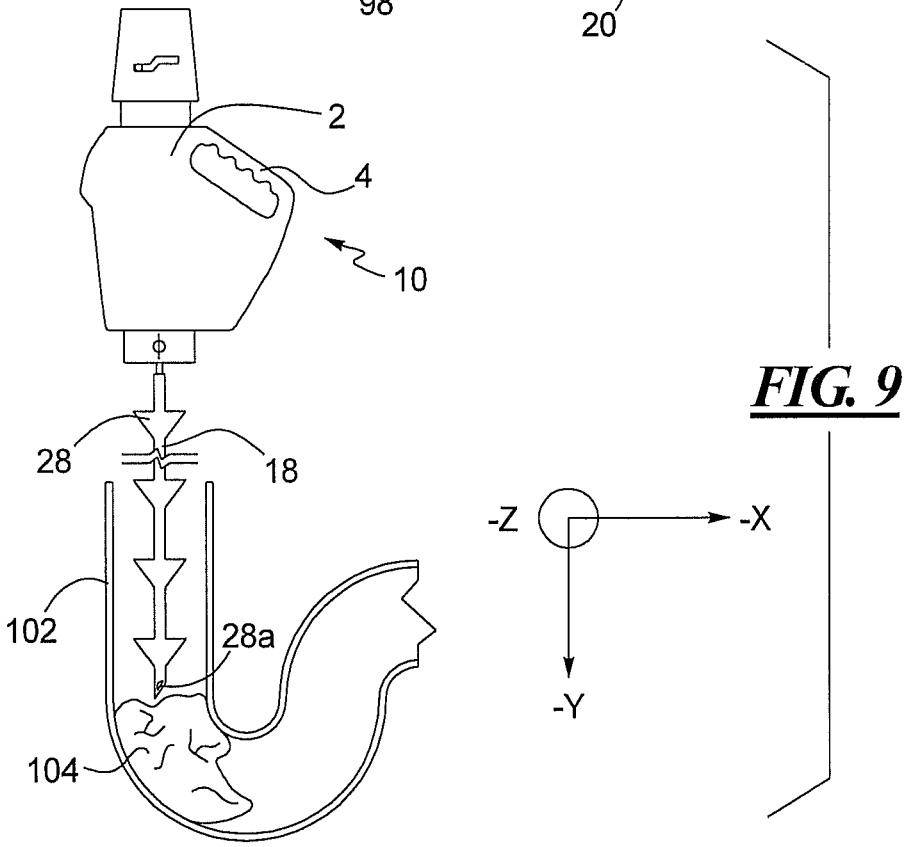
FIG. 9 is a cross-sectional view of a non-limiting embodiment of a drain clog remover as it may be used according to the present disclosure.

FIG. 9 shows an exemplary embodiment of a drain clog remover 10 according to the present invention as it may be used. As described throughout, the drain clog remover 10 provides mechanical and chemical actions to remove a clog or clog material 104 formed in a drain 102. In one embodiment, while holding the container 2 (such as about the handle 4), a user may insert the shaft 18 into the drain 102 until the shaft distal end 18*a* engages the clog material 104. In the embodiment shown, the shaft 18 is formed of a flexible material such that it may traverse a tortuous path before it engages the clog 104. As described above, the shaft 18 may be manipulated within the drain to contact and dislodge all or a portion of the clog by moving, or otherwise agitating, the container 2. With the shaft 18 still positioned inside the drain and the distal end 18*a* adjacent the clog, the user may then actuate the drain clog remover (i.e., release the pressurized fluid) to discharge drain cleaning composition that may have been stored in the container 2 and into the drain 102 through the shaft 18.

Because of the presence of the shaft 18, the drain cleaning composition may be more accurately dispensed in the immediate vicinity of the clog 104. It is thought that such a configuration for a drain clog remover provides additional benefits to a consumer, rather than simply having the consumer pour drain cleaning composition and waiting or pouring drain cleaning composition into the drain 102 and then somehow using a mechanical device (such as a snake or a wire hanger) to engage the clog 104 due to the relative proximity of the cleaning composition upon a direct pour into the drain. It will be appreciated, therefore, that both mechanical and chemical actions are used substantially simultaneously to remove the clog from the drain 102.

As described above, individually marketed mechanical and chemical drain clog removers are not intended for combined use. Practical considerations (splashing, etc.) may prevent effective simultaneous (or near simultaneous use) of a mechanical and chemical product. Further, while it is possible to use a mechanical means followed by a chemical means to minimize splashing issues, it is surprisingly discovered by the present invention that by dispensing the chemical means at the situs of the clog, then the area near, at, or behind, a physical clog may be provided with chemical means 106, such as a chemical drain clog remover. By providing the chemical means 106 further into the drain pipe at assembly, a drop of drain cleaning product concentration may be avoided. It is thought that as much as about 5% to about 10% of the total amount of drain cleaning composition that is poured into a drain (based on a 32 oz bottle) may be lost due (in part) to dilution, or otherwise clinging and/or sticking to the side of the drain pipe. The ability to provide an additional amount of drain clog removing composition at the specific site of the clog is thought to provide a relatively significant benefit to the user in terms of overall performance.

Drain Clog Remover: Consumer Presentation

As discussed earlier, one limitation of many drain clog removal solutions is that the consumer is not provided with any level of interactivity. Consumers also often understand that the combining of chemical and mechanical drain clog removal means is somewhat impractical due to physical considerations. By providing a drain clog remover (device or apparatus) which clearly provides a cue or other signal to the consumer that it provides: (a) more than one means for drain clog removal, (b) one or more indicium on the product and/or product packaging indicating that the apparatus provides more than one means for drain clog removal.

As discussed above, in some non-limiting embodiments, the more than one means for drain clog removal may be a chemical means, such as the Drano Max Gel® product (S.C. Johnson & Son, Co., Racine, Wis.). In other non-limiting embodiments, the apparatus or device may also comprise a propellant means, such as a compressed gas or compressed air. The propellant may be used to aid in the dispensing of the chemical means. Alternatively, the propellant may be used to act as a means for pushing, or otherwise moving, the clog. In other non-limiting embodiments, the more than one means for drain clog removal may be a mechanical means, such as a "pipe snake". In certain embodiments, the mechanical means provides action in a so-called "backwards" and "forwards" direction. As used herein, "backwards" and "forwards" generally refer to the X and Y-directions. In other words, the mechanical means may be used to push and/or engage and/or pull the drain clog material. The mechanical means may be contrasted to another means, such as a chemical means, because the chemical means may be used to dissolve the clog material itself. As described throughout, in some embodiments, the chemical means may provide an initial action (i.e., drain clog destroying) to the clog site itself ($C_{site}$, FIG. 10).

In addition to actually providing an actual apparatus, or device, that provides the benefits and functionality of multiple drain clog removal means to a consumer, in some embodiments, the present invention may also provide the additional consumer benefit of providing communication to the consumer that there are multiple drain clog removal means. Providing such a communication may give a producer of such an apparatus, or device, the advantage of removing any at-the-shelf confusion for consumers. The apparatus or device for removing a clog in a drain pipe assembly may comprise packaging 200 for the drain clog remover 10 (FIG. 11). In one embodiment, the packaging 200 comprises a first indicium 276 that communicates to the consumer that the apparatus provides multiple means for removing drain clogs. In another embodiment, the packaging comprises a second indicium 277 that communicates to the consumer that the apparatus is such that at least one of the drain clog removal means is activated at the site of the clog.

Alternatively, the apparatus or device may comprise a label wherein the label provides a first indicator, the first indicator communicating to the consumer that the device comprises at least two means for removing a clog. In some embodiments, the first indicator provides to the consumers that the at least two means are different. In additional embodiments, the label may comprise a second indicator that communicates to the consumer that the apparatus provides a means for removing a clog that allows for consumer interaction.

It is noted that terms like "specifically," "preferably," "typically," "generally," and "often" are not utilized herein to limit the scope of the claimed invention or to imply that certain features are critical, essential, or even important that certain features are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of the invention.

INDUSTRIAL APPLICABILITY

The apparatus and methods disclosed herein may be used to remove clogs from drain pipes.

We claim:

1. An apparatus for removing a clog from a drain pipe, the apparatus comprising:

a) a container comprising a product chamber, the product chamber being adapted to receive and retain a drain cleaning composition, the product chamber having an inlet and an outlet;

b) a pressurization assembly in fluid communication with the inlet, the pressurization sub-assembly comprising a canister of pressurized fluid and an adapter coupled to the container and including a socket defining a receptacle configured to receive at least a portion of the canister;

c) a shaft coupled to the container, the shaft being longer than the container and comprising a proximal end and a distal end, the shaft having an exterior surface sized for insertion into the drain pipe; the shaft further comprising a channel that provides fluid communication between the proximal end and the distal end; and d) projections extending outwardly from the shaft.

2. The apparatus of claim 1, further comprising an actuation cap engaging the canister, the actuation cap being movable between an initial position, in which the canister remains closed, and an actuated position, in which the canister communicates pressurized fluid to the container chamber.

3. The apparatus of claim 1, further comprising a valve juxtaposed between the container outlet and the shaft, the discharge valve being movable between open and closed positions thereby to control flow of the drain cleaning composition through the outlet.

4. The drain clog remover of claim 1, in which the discharge valve comprises a ball valve.

5. The drain clog remover of claim 1, in which the shaft is sufficiently flexible to be bent into an arcuate shape.

* * * * *